US010206452B2

(12) United States Patent
Ramirez, II

(10) Patent No.: US 10,206,452 B2
(45) Date of Patent: Feb. 19, 2019

(54) FREE WEIGHT EXERCISE SHOES

(71) Applicant: Ricardo Mateo Ramirez, II, Bastrop, TX (US)

(72) Inventor: Ricardo Mateo Ramirez, II, Bastrop, TX (US)

( * ) Notice: Subject to any disclaimer, the term of this patent is extended or adjusted under 35 U.S.C. 154(b) by 357 days.

(21) Appl. No.: 15/147,455

(22) Filed: May 5, 2016

(65) Prior Publication Data

US 2016/0345656 A1 Dec. 1, 2016

Related U.S. Application Data

(60) Provisional application No. 62/166,309, filed on May 26, 2015.

(51) Int. Cl.

| | |
|---|---|
| ***A43B 5/18*** | (2006.01) |
| ***A63B 21/00*** | (2006.01) |
| ***A63B 21/06*** | (2006.01) |
| ***A63B 21/065*** | (2006.01) |
| ***A63B 21/072*** | (2006.01) |
| ***A63B 21/16*** | (2006.01) |
| ***A63B 23/035*** | (2006.01) |
| ***A63B 23/08*** | (2006.01) |
| ***A63B 23/02*** | (2006.01) |
| ***A63B 23/04*** | (2006.01) |

(52) U.S. Cl.

CPC ..... *A43B 5/18* (2013.01); *A63B 21/065* (2013.01); *A63B 21/16* (2013.01); *A63B 21/4015* (2015.10); *A63B 21/4034* (2015.10); *A63B 21/4043* (2015.10); *A63B 23/0205* (2013.01); *A63B 23/03508* (2013.01); *A63B 23/04* (2013.01); *A63B 23/08* (2013.01); *A63B 21/0604* (2013.01); *A63B 21/072* (2013.01); *A63B 2225/09* (2013.01)

(58) Field of Classification Search

CPC ..... A63B 21/062; A63B 21/4015; A43B 3/16; A43B 3/18–3/20; A43B 5/18; A43B 23/081–23/087

See application file for complete search history.

(56) References Cited

U.S. PATENT DOCUMENTS

| | | | | |
|---|---|---|---|---|
| 5,893,223 A * | 4/1999 | Glass | ..... | A43B 5/00 36/132 |
| 7,543,399 B2 * | 6/2009 | Kilgore | ..... | A43B 3/24 36/101 |

* cited by examiner

*Primary Examiner* — Loan H Thanh
*Assistant Examiner* — Jennifer M Deichl
(74) *Attorney, Agent, or Firm* — Pierson IP, PLLC

(57) ABSTRACT

Embodiments are related to systems and methods that utilize shoes with an attachment member to couple with weights, wherein the attachment member may allow the weights to have a free range of motion when coupled with the shoes. Responsive to coupling the weights with the attachment member, a user may utilize the shoes to target specific muscle groups of the user's lower body.

7 Claims, 15 Drawing Sheets

FREE WEIGHT EXERCISE SHOES

CROSS-REFERENCE TO RELATED APPLICATIONS

This application claims a benefit of priority under 35 U.S.C. § 119 to Provisional Application No. 62/166,309 filed on May 26, 2015, which is fully incorporated herein by reference in its entirety.

BACKGROUND INFORMATION

Field of the Disclosure

Examples of the present disclosure are related to systems and methods for free weight exercise shoes. Specifically, embodiments are related to exercise shoes with an attachment member that covers the front of the exercise shoe, wherein a weight coupled to the attachment member has a free range of motion and rotation.

Background

Weight training is a common type of strength training for developing the strength and size of skeletal muscles. Weight training uses the weight force of gravity, in the form of weight bars, dumbbells, etc. to oppose the force generated by muscle through concentric or eccentric contractions.

Conventionally weight training uses a variety of specialized equipment to target specific muscle groups and types of movements. The equipment may include resistance bands, cabled weight machines, and free weights.

However, resistance bands typically restrict the range of motion on the user, while also creating unnecessary stress on the expanded muscle groups. Cabled weight machines typically provide an inadequate range or motion, and also consume large spaces. Free weights have a high cost associated with them, while also consuming large spaces. Furthermore, conventional weight training using free weights are typically used to increase the upper body strength of users. However, there are limited options for users to increase their lower body strength using free weights.

Accordingly, needs exist for a more efficient and effective systems and methods for a shoe cover configured to be positioned on the ends of shoes, wherein a free weight may be coupled to the shoe cover to target lower body muscles.

SUMMARY

Embodiments disclosed herein describe systems and methods that utilize a shoe cover with an attachment member to couple with free weights. The attachment member may allow the weights to have a free range of motion when coupled with the shoes. Responsive to coupling the weights with the attachment member on the shoe cover, a user may utilize the shoe cover to target specific muscle groups of the user's lower body.

Embodiments may include a first attachment member positioned at the front tips of a shoe, and may include a second attachment member positioned at the heel of the shoe.

Embodiments may be configured to create moment arms at selected position associated with the attachment members. The created moment arms may be based on weight attachment schemes formed by the positioning and free range of motion of the free weight. In embodiments, kettle bells and other free weights may be used as the weight, wherein different coupling members may be fixed to the attachment member to accommodate different styles of weights. Furthermore, the shoe may include a plurality of rigid subsections that may be configured to support bending created by the moment arms and the force of the weight.

Embodiments may include a shoe cover that is configured to be positioned over a front end of a shoe. The shoe cover may include a shoe coupling system and a plurality of attachment members.

The shoe coupling system may include a plurality of slots, holes, etc. positioned proximate to a circumference of the shoe cover near an open face of the shoe cover. Two slots may be positioned on an upper curved surface of the shoe cover, and a single slot may be positioned on a bottom, planar surface of the shoe cover. Straps may be configured to be inserted into the slots, and positioned around and underneath a shoe. The straps may include a first portion, second portion, and a third portion. The first portion may be configured to couple with the two slots, and extend around a rear of a shoe. The second portion may be configured to couple with the lower slot, and extend underneath a sole of the shoe, and couple with the first portion at the rear of the shoe. The third portion may be configured to extend around a circumference of the shoe, and the third portion may extend in a direction that is substantially perpendicular to the first and second portions.

A first type of attachment members may be configured to be positioned around a circumference of the shoe cover, and a second type of attachment member may be positioned at the end of the shoe cover. In embodiments, the first type of attachment members and the second type of attachment members may be the same and/or different shape and/or sizes. The first type of attachment members may be curved, semi-circle rings. One of the first types of attachment members may be configured to be positioned substantially perpendicular to two of the first types of attachment members. The second type of attachment member may be substantially "H" shaped, and may extend away from the shoe cover. The shape of the second type of attachment member may be configured to allow a weight to be coupled in a position in front of the shoe cover.

Embodiments may be configured for a home gym for a user to strengthen their lower body. The shoes may be configured to be coupled with existing weights or custom made weights. Furthermore, embodiments may provide a wider range of motion than conventional exercise machines, which may require less space than conventional alternatives.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present embodiments are described with reference to the following figures, wherein like reference numerals refer to like parts throughout the various views unless otherwise specified.

Figure 1:
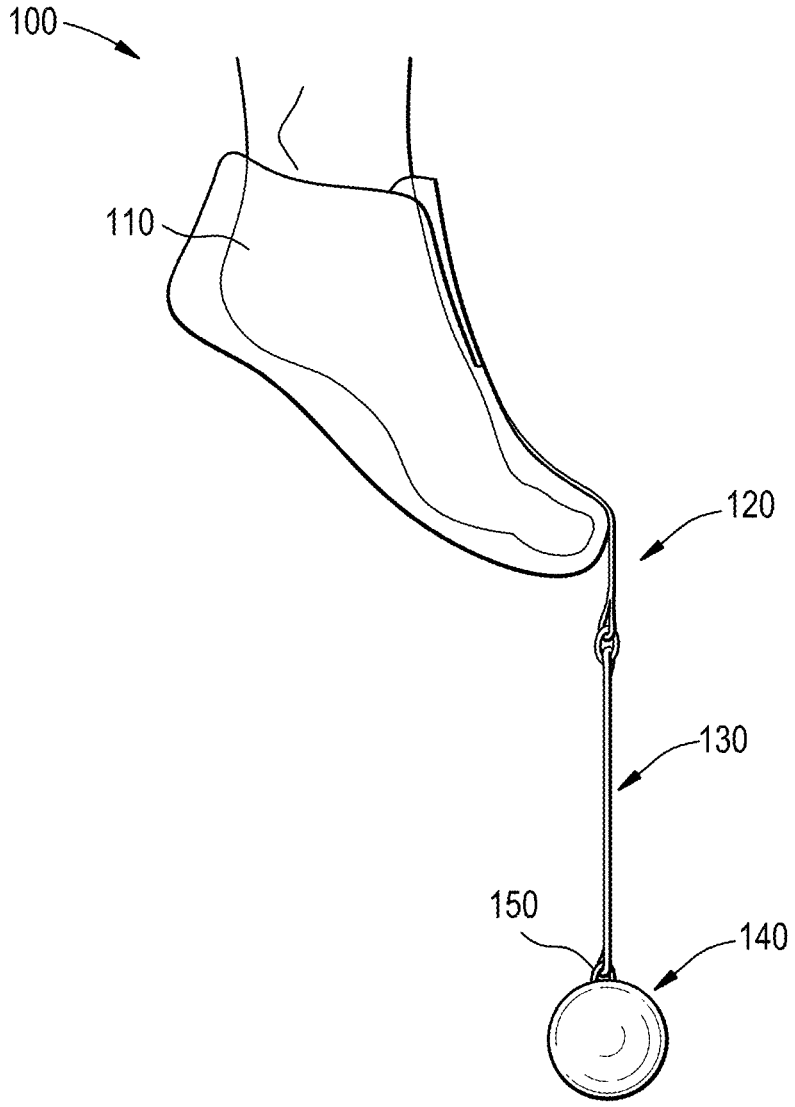
FIG. 1 depicts a weightlifting shoe configured to assist strengthening a user's lower body, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments disclosed herein describe systems and methods that utilize shoes with an attachment member to couple with weights. The attachment member may be configured to allow the weights to have a free range of motion when coupled with the shoes. Responsive to coupling the weights with the attachment member, a user may utilize the shoes to target specific muscle groups of the user's lower body and abdomen.

Turning now to FIG. 1, FIG. 1 depicts a weightlifting shoe 100 configured to assist strengthening a user's lower body, according to an embodiment. Weightlifting shoe 100 may include shoe 110, first attachment member 120, coupling cable 130, weight 140, and a second attachment member.

Shoe 110 may be an item of footwear intended to protect and comfort the human foot while doing various activities. Shoe 110 may be an athletic shoe that is configured to cover the foot and ankle of the user. Shoe 110 may be comprised of various materials, such as cloth, rubber, plastics, leather, etc.

First attachment member 120 may be positioned at a tip of the toes of shoe 110. First attachment member 120 may include a projection configured to extend away from the toe cap of shoe 110 and a sphere. The sphere may be a ball joint with spherical bearings that connect with the projection, wherein the projection may be a control arms. The sphere may be configured to allow first attachment member 120 to have free movement in two planes at the same time, including rotating in those planes. In embodiments, the sphere may have a hollow channeled that extends through the body of the sphere.

Coupling cable 130 may be a rope, chord, cable, etc. comprised of various materials, such as metal, plastic, leather, etc. Coupling cable 130 may be comprised of flexible material that is able to bend, twist, rotate, etc. Coupling cable 130 may also be comprised of a material that is strong enough to support weight 140. In embodiments, coupling cable 130 may couple with first attachment member 120 at a location that is away from the tip of shoe 110. Therefore, via coupling cable 130, weight 140 may move in directions over, behind, or on either side of shoe 110. Additionally, via the sphere within first attachment member 120, coupling cable 130 may be configured to move in a plurality of directions and at a plurality of rotational directions. Because coupling cable 130 is configured to move in all directions around the toe cap of shoe 110, a plurality of exercises may be performed utilizing shoe 110.

Weight 140 may be an object that is configured to be used by a user to perform exercises that combine cardiovascular, strength, and flexibility training. Weight 140 may be comprised of various materials with sufficient weight for training. In embodiments, weight 140 may be a steal ball, kettle bell, or any other type of desired weight.

The second attachment member may be positioned on the rear side of shoe 110. The second attachment member may be configured to support a second weight (not shown) that is independent of weight 140. In embodiments, the second attachment member may be a strap that is configured wrap around the user's ankle, wherein a weight may be coupled behind the ankle of the user. Accordingly, using first attachment member 120 and the second attachment member, a user may train various muscles on the user's lower body. In embodiments, the second attachment member may include a projection that extends away from the ankle of shoe 110 and a sphere. The sphere may be a ball joint with spherical bearings that connect with the projection, wherein the projection may be a control arms. The sphere may be configured to allow the second attachment member to have free movement in two planes at the same time, including rotating in those planes. In embodiments, the sphere may have a hollow channeled that extends through the body of the sphere. In embodiments, a second coupling cable may couple with the second attachment member at a location that is away from the ankle of shoe 110. Therefore, via the second coupling cable, a second weight may move in directions over, behind, or on either side of shoe 110. Additionally, via the sphere within the second attachment member, the second coupling cable 130 may be configured to move in a plurality of directions and at a plurality of rotational directions.

In a first embodiment, a user may place a first foot on a ledge, while weightlifting shoe 100 is positioned over a second foot. Weightlifting shoe 100 may be coupled to weight 140, wherein the user may move pivot their knee and raise and lower their heel. This embodiment may be configured to increase the strength of the user's hamstring. In a second embodiment, a user may couple a weight to the weightlifting shoe 100, and be positioned in a seated position. The user may raise and lower the toes, while pivoting their ankle. This embodiment may be configured to increase the strength of the user's shins.

Figure 2:
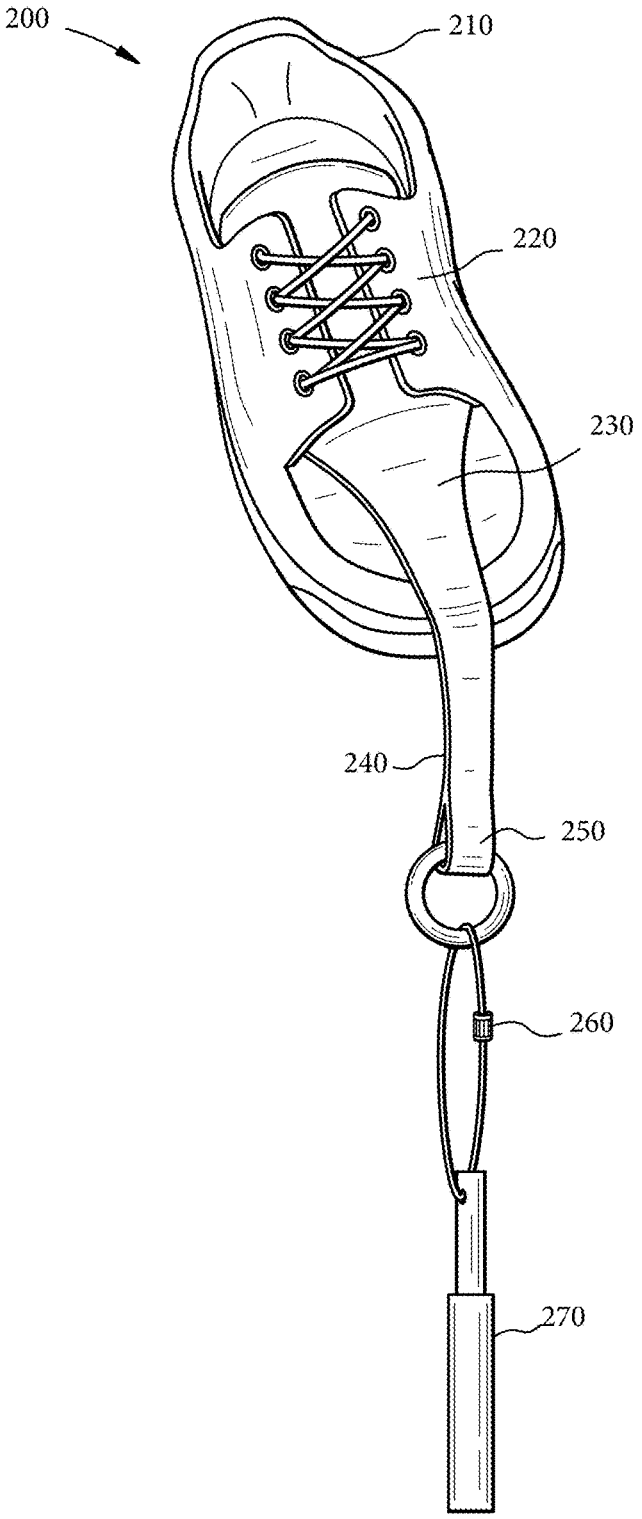
FIG. 2 depicts a weightlifting shoe, according to an embodiment.

FIG. 2 depicts a weightlifting shoe 200, according to an embodiment. Weighting shoe 200 may include shoe 210, side panels 220, top panel 230, cable 240, attachment member 250, coupling device 260, and weight 270.

Shoe 210 may be comprised of multiple side panels 220 and top panel 230. Side panels 220 may be comprised of a rigid or semi-rigid material that is configured to support bending of shoe 210 caused by weight 270. In embodiments, side panels 220 and top panel 230 may be configured to be layered over a less rigid internal shoe, wherein side panels 220 and top panel 230 are comprised of a different material than the internal shoe. Accordingly, side panels 220 and top panel 230 may encase an internal shoe. In embodiments, side panels 220 and top panel 230 may be comprised of different materials than the portions of shoe 210 positioned from the end of side panels 220 to the heel of shoe 210.

Top panel 230 of the shoe may be a unified piece extending from a tongue of the shoe, above the laces, through the laces, through the toe box of the shoe, and past the toe cap. In embodiments, top panel 230 may extend into cable 240, wherein cable may be comprised of a rigid material, such as leather. Because top panel 230 may extend from the tongue of the shoe to a location past the top cap, shoe 210 may be configured to support weight 270. Furthermore, when weight 270 applies force to top panel 230 via cable 240, weight 270 may stretch 230. However, because side panels 220 may be comprised of rigid materials, side panels 420 may reduce bending, flexing, etc. caused by weight 270.

At a distal end of cable 240 may be attachment member 250. Attachment member 250 may be a ring that is configured to be inserted into a channel positioned on the distal end of cable 240, wherein attachment member 250 is positioned away from the top cap of shoe 210. Coupled to a second end of the ring, may be coupling device 260. Coupling device 260 may be a carabineer, steal cable, etc., wherein coupling device may link weight 270 to attachment member 250. In embodiments, coupling device 260 may be a removable and adjustable coupling device, wherein coupling device 260 may be affixed to and removed from attachment member 250. Therefore, by removing coupling device 260, weight 270 may also be detached from shoe 210.

Figure 3:
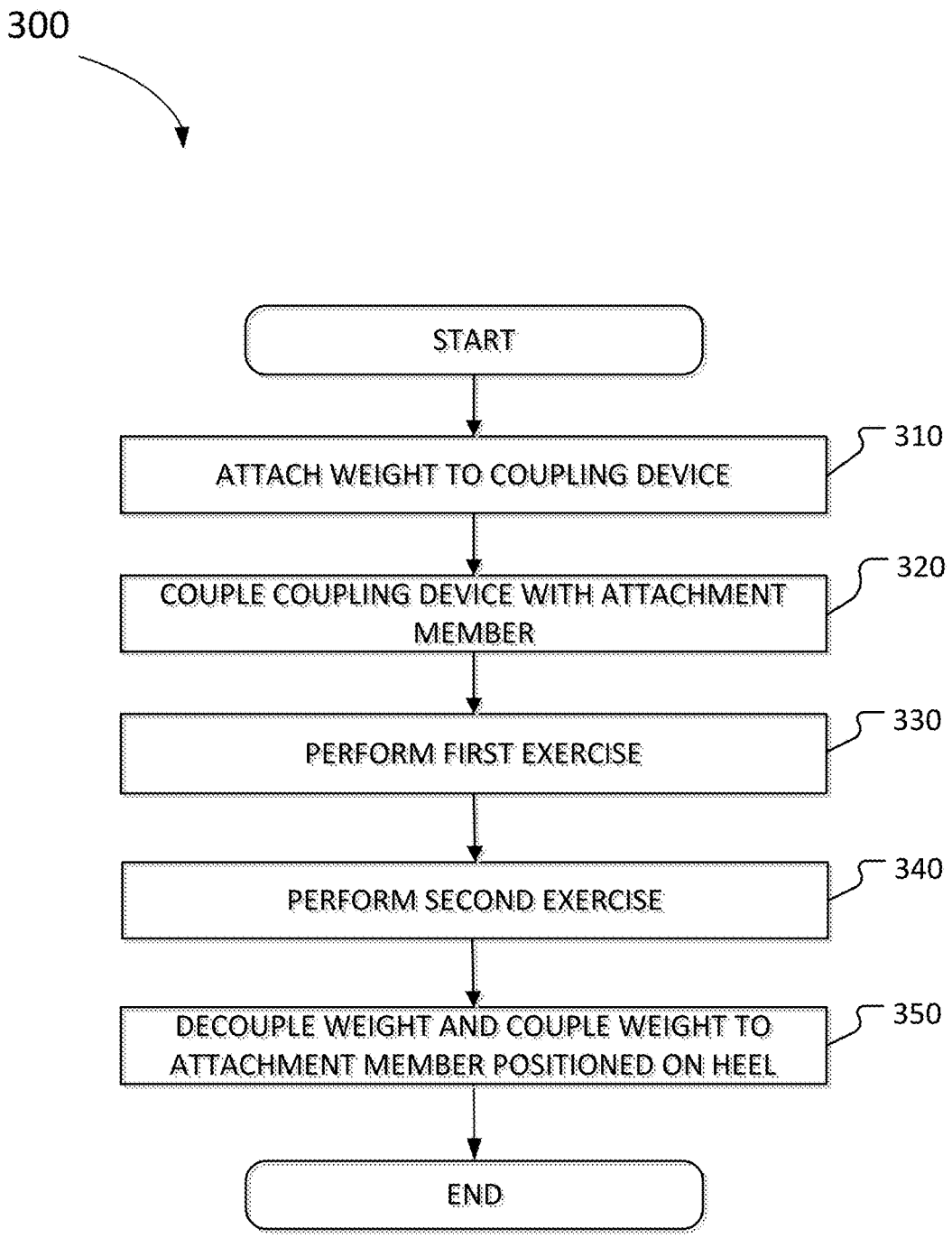
FIG. 3 depicts a method for utilizing exercise shoes, according to an embodiment.

FIG. 3 depicts a method 300 for utilizing exercise shoes. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

At operation 310, a weight may be attached to a coupling device. The weight may be a kettle bell, dumbbell, steel ball, or any other type of desired weight.

At operation 320, the coupling device may be coupled to an attachment member of a shoe. In embodiments, the attachment member may extend from a position at the tongue of the shoe to a positioned in front of the toe cap of the shoe. The attachment member may be a length of leather, wherein the leather may be positioned on the upper portion of the shoe and the sole of the shoe.

At operation 330, the user may perform a first exercise that requires the attachment member to be positioned on the upper portion of the shoe and hinge around the toe cap of the shoe. In embodiments, responsive to the weight applying pressure to the attachment member, rigid side panels on the shoe may allow the weightlifting shoe to maintain its integrity, and limit bending of the shoe.

At operation 340, the user may perform a second exercise that requires the attachment member to be positioned on the sole of the shoe and hinge around the toe cap of the shoe. In embodiments, responsive to the weight applying pressure to the attachment member, rigid side panels on the shoe may allow the weightlifting shoe to maintain its integrity, and limit bending of the shoe.

At operation 350, the weight may be removed from the first coupling device, and positioned on a second attachment member, wherein a first portion of the second attachment member is coupled above the heel counter of the shoe. The second end of the second attachment member may project away from a surface of the shoe.

Figure 4:
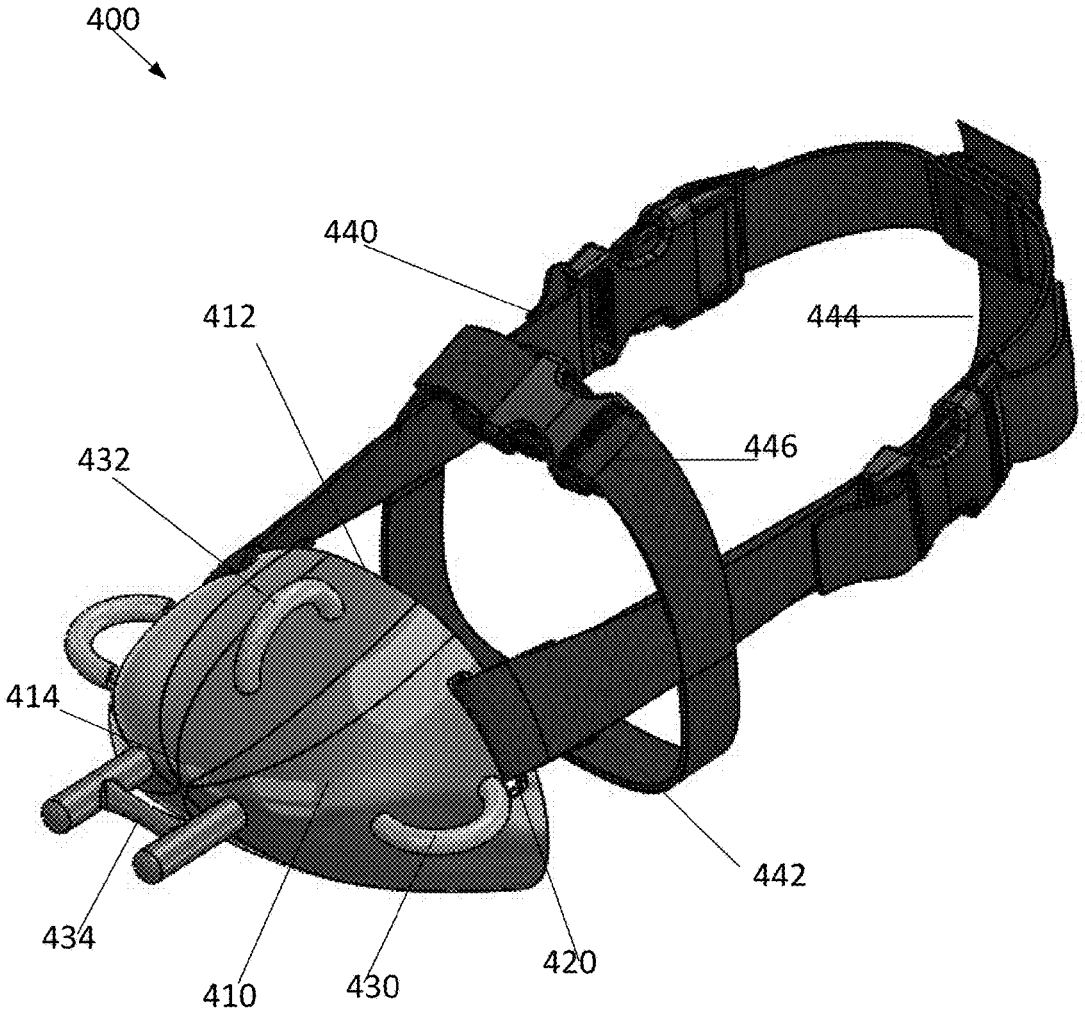
FIG. 4 depicts an embodiment of an exercise shoe cover system, according to an embodiment.

FIG. 4 depicts an embodiment of an exercise shoe cover system 400, according to an embodiment. Exercise shoe cover system 400 may be configured to allow a user to perform lower body workout excises to work the various muscles located within the ankle to strengthen and/or rehabilitate. Embodiments of exercise shoe cover system may be used in connection with free weights, cable pulley systems, etc. Exercise shoe cover system 400 may include a shoe cover 410, slots 420, coupling members 430, and strap system 440.

Shoe cover 410 may include an open end 412 and a closed end 414. A shoe may be configured to be inserted into shoe cover 410 via open end 412, and a toe of the shoe may be configured to be positioned adjacent to an inner surface of closed end 414. Shoe cover 410 may be comprised of various rigid materials, such as plastic, metal, etc. Shoe cover 410 may be configured to encompass and end of a shoe of a user, and distribute external forces to an foot of a user.

Slots 420 may be positioned proximate to an open end 412 of shoe cover 410, and positioned around a circumference of shoe cover 410. Slots 420 may be holes, orifices, openings, etc. extending through shoe cover 410. Slots 420 may be configured to receive strap system 440 to secure exercise shoe cover system 400 to a foot of a user. In embodiments, shoe cover 400 may include a plurality of slots 420, where two slots 420 are positioned on an upper surface of shoe cover 400, and a third slot 420 is positioned on a lower surface of shoe cover. Slots 420 may be positioned to distribute external forces to the ankle of the user via strap system 440.

Coupling members 430 may be positioned on an external surface of shoe cover 410. Coupling members 430 may include a projection that is configured to receive resistance from an external device, such as a rope or pulley system, free weight, etc.

In embodiments, a first type of coupling members 432 may be positioned on a top surface of shoe cover, and a second type of coupling member 434 may be positioned on the closed end 414 of shoe cover. The first type of coupling members 432 may be substantially semi-circle in shape, and the second type of coupling members 434 may be substantially "H" shaped.

Strap system 440 may include straps that may be configured to be inserted into slots 420, and positioned around and underneath a shoe. The straps may include a first portion 442, second portion 444, and a third portion 446.

The first portion 442 may be configured to couple with the two slots 420, and extend around a rear of a shoe. The second portion 444 may be configured to couple with a slot positioned on the bottom surface of shoe cover 410, and extend underneath a sole of the shoe, and couple with the first portion 442 at the rear of the shoe. The third portion 4446 may be configured to extend around a circumference of the shoe, and the third portion 446 may extend in a direction that is substantially perpendicular to the first 442 and second 444 portions.

Figure 5A:
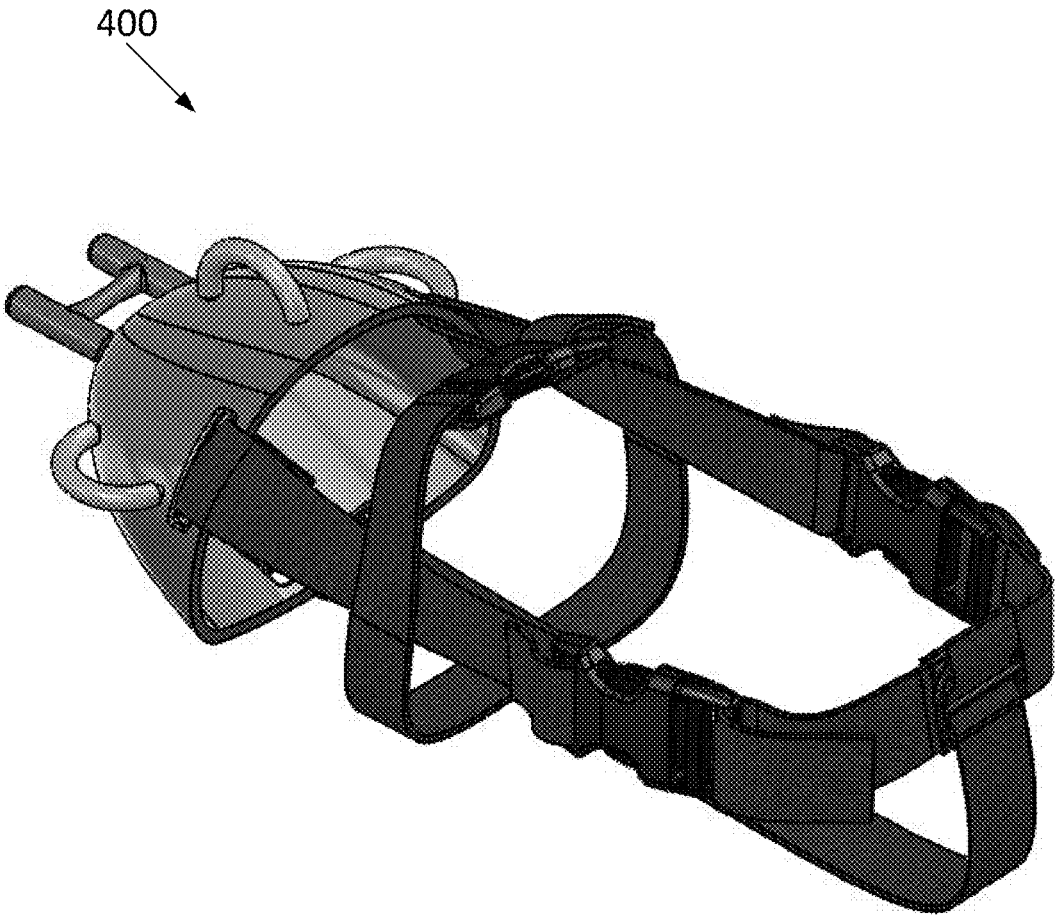
FIGS. 5A-5C depict various views of exercise shoe cover system, according to an embodiment.
Figure 5B:
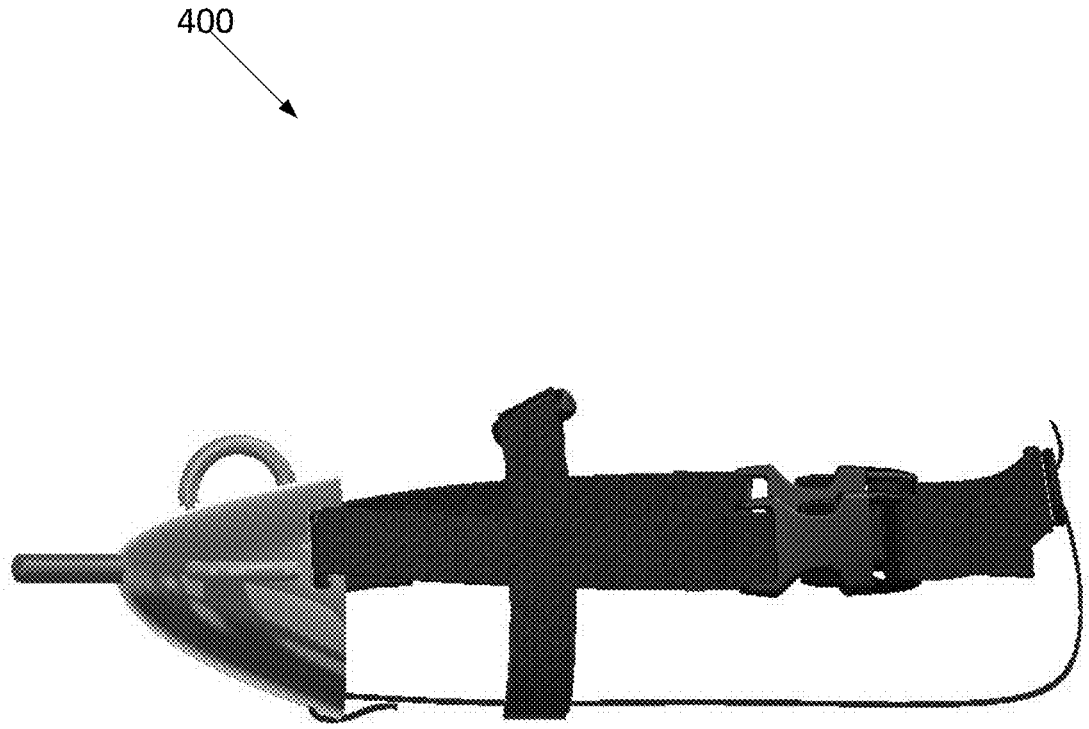
Figure 5C:
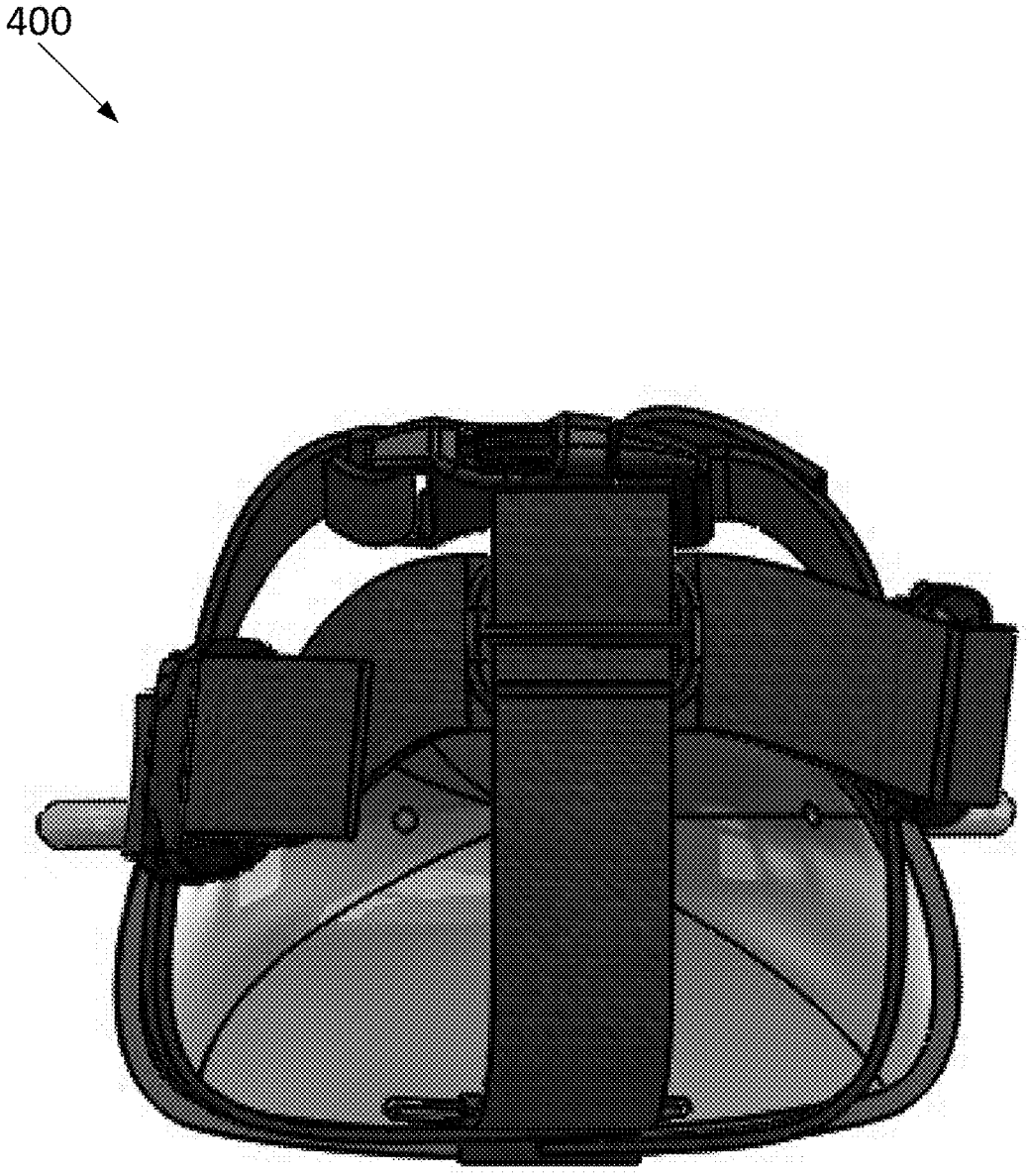

FIGS. 5A-5C depict various views of exercise shoe cover system 400. Elements depicted in FIGS. 5A-5C may be substantially the same as those described above. For the sake of brevity, a further description of these elements is omitted.

Figure 6:
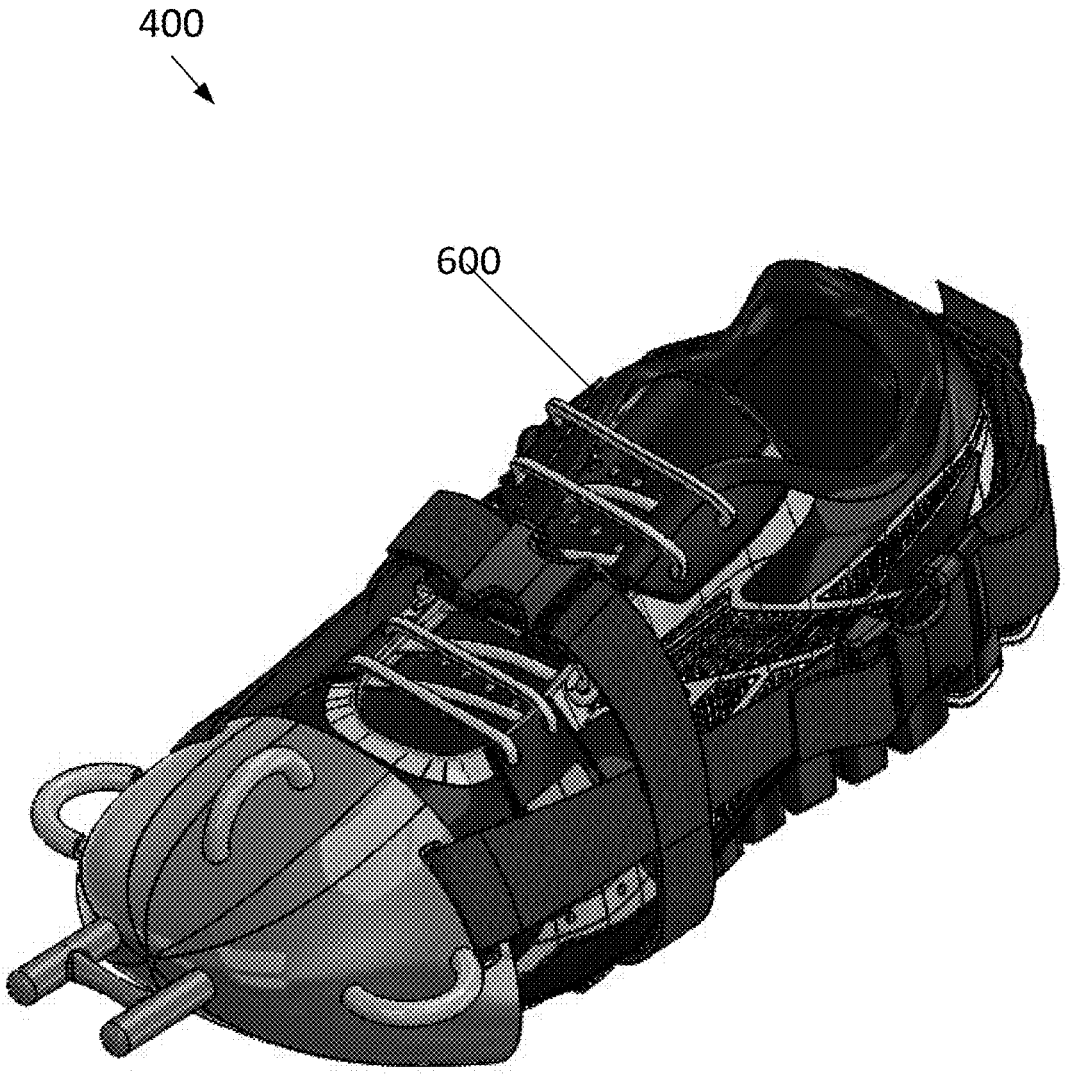
FIG. 6 depicts an embodiment of exercise shoe cover system coupled with a shoe, according to an embodiment.

FIG. 6 depicts an embodiment of exercise shoe cover system 400 coupled with a shoe 600. Elements depicted in FIG. 6 may be substantially the same as those described above. For the sake of brevity, a further description of these elements is omitted.

Figure 7:
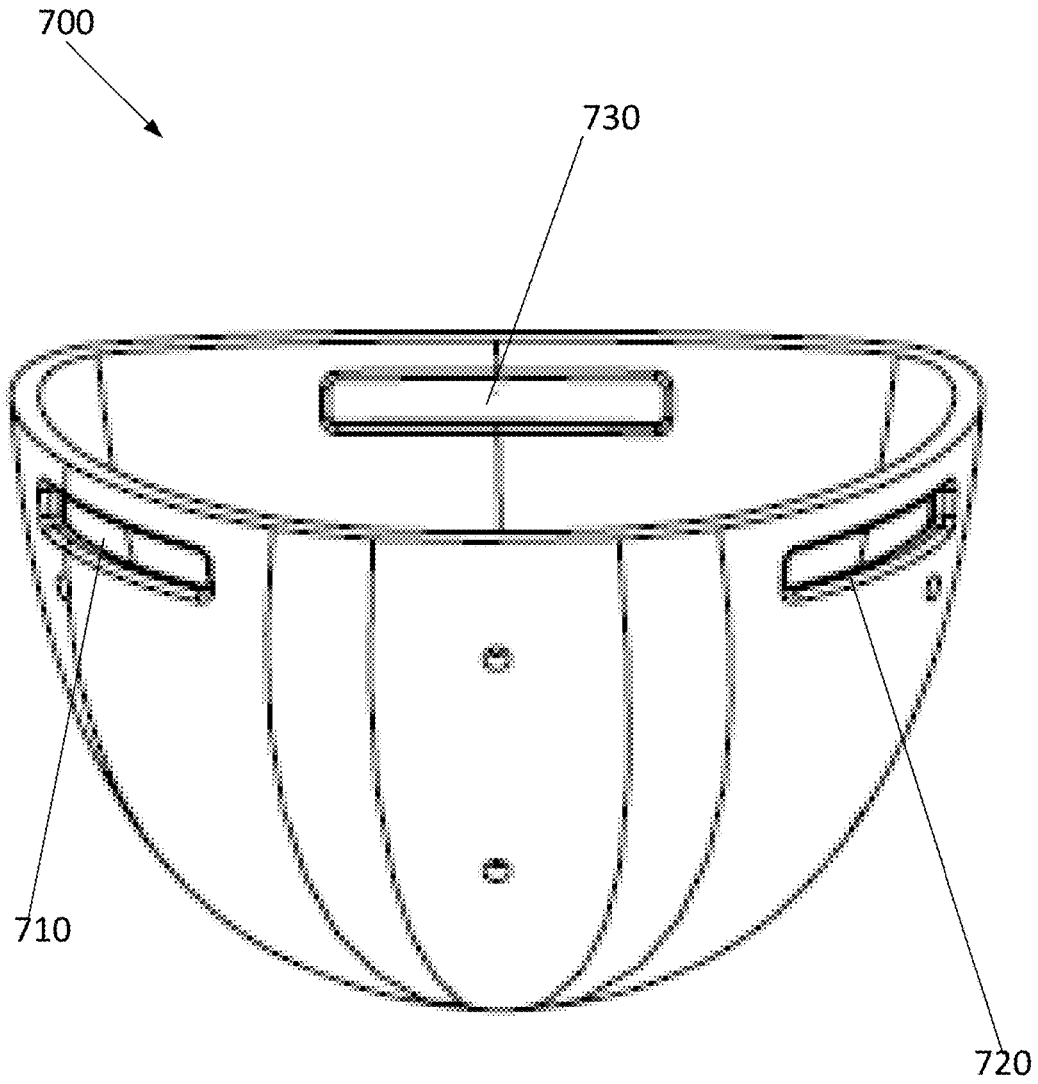
FIG. 7 depicts a top view of a shoe cover, according to an embodiment.

FIG. 7 depicts a top view of an embodiment of shoe cover 700. As depicted in FIG. 7, show cover 700 may include a plurality of slots 710, 720, and 730. Each of the slots may be configured to receive a strap from a strap system to couple shoe cover 700 to a shoe.

As depicted in FIG. 7, two of the slots 710, 720 may be positioned on an upper surface of shoe cover 700, and a third slot 730 may be positioned on a lower surface of shoe cover 700. By varying the positioning of slots 710, 720, 730, shoe cover 700 may better distribute force to a foot of a user. In embodiments, third slot 730 may be configured to be positioned between first slot 710 and second slot 720 along a width of shoe cover 700.

As also depicted in FIG. 7, first slot 710 and second slot 720 may be configured to be positioned closed to closed end 702 of shoe cover 700 than third slot 730. This may be because the length of the lower surface of shoe cover 700 may be longer than the length of the upper surface of shoe cover 700. In embodiments, the lower surface may be upwardly angled across the longitudinal axis of the shoe cover, and be planar across a lateral axis of the shoe cover.

Figure 8:
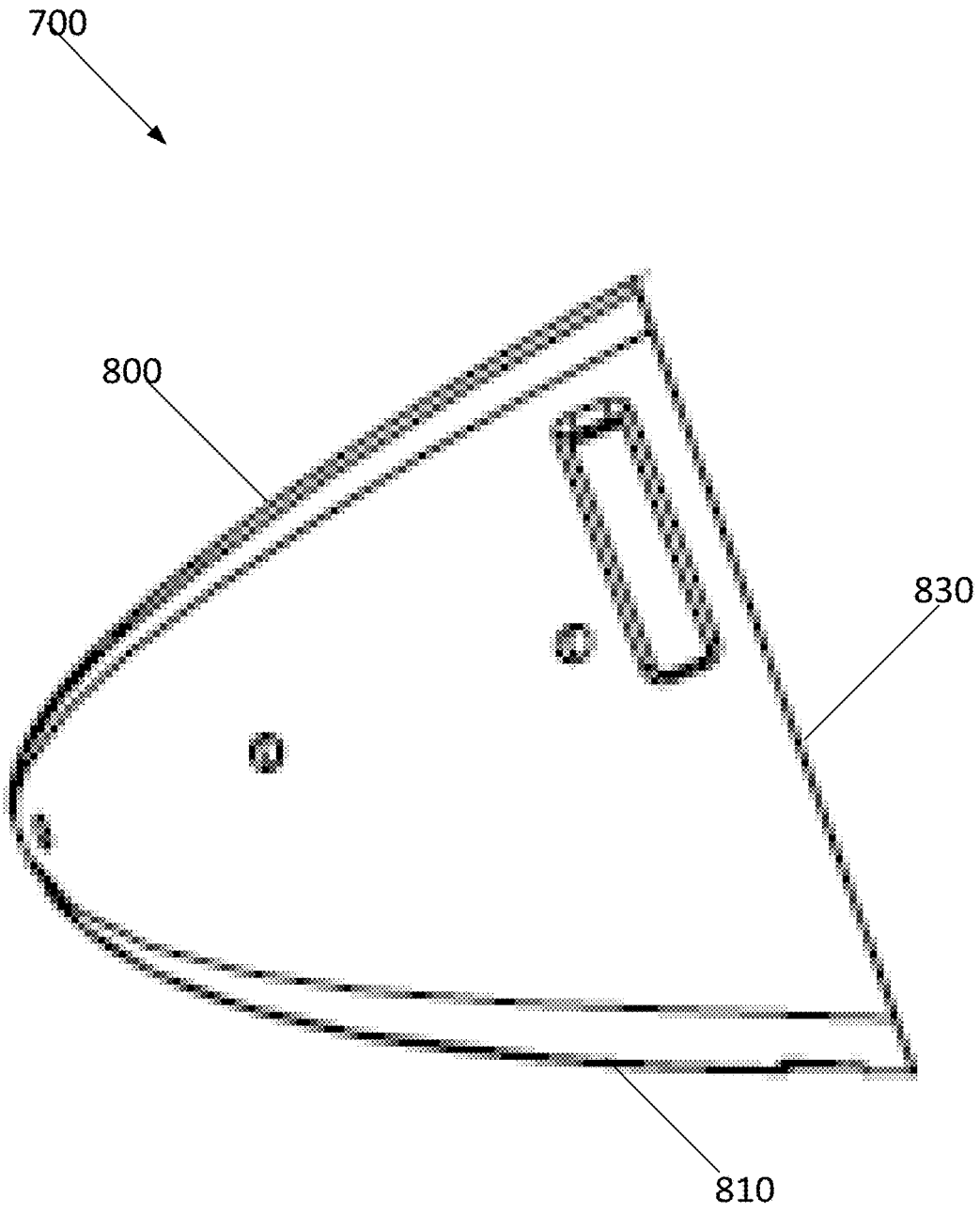
FIG. 8 depicts a side view of a shoe cover, according to an embodiment.

FIG. 8 depicts a side view of an embodiment of shoe cover 700. As depicted in FIG. 8, shoe cover 700 may have a slanted upper surface 800, and a more flat lower surface 810. Slated upper surface 800 may be configured to engage with an upper surface of a shoe, and lower surface 810 may be configured to engage with a sole of the shoe. Furthermore, the open end 830 of shoe cover 700 may have a longer length than upper surface 800 of shoe cover 700, and a shorter length than the lower surface 810 of shoe cover 700. In embodiments, the upper surface may be downwardly angled across the longitudinal axis and lateral axis of the shoe cover.

Figure 9:
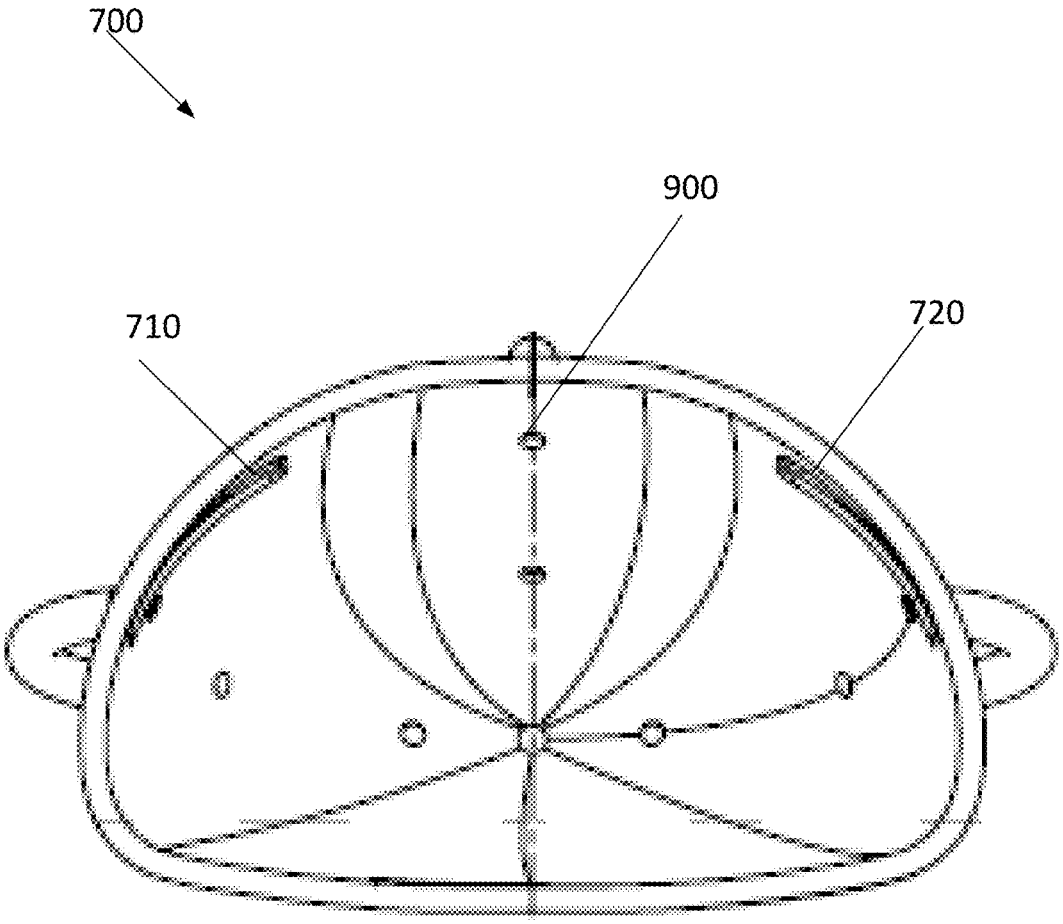
FIG. 9 depicts a front view of a shoe cover, according to an embodiment.

FIG. 9 depicts a front view of an embodiment of shoe cover 700. As depicted in FIG. 9, first slot 710 and second slot 720 may be positioned on a rounded, upper surface of shoe cover 700, while the third slot (not shown) may be positioned on a planar, lower surface of shoe cover 700. As further depicted in FIG. 9, shoe cover 700 may include a plurality of female holes 900, wherein female holes 900 are configured to receive coupling members.

Figure 10:
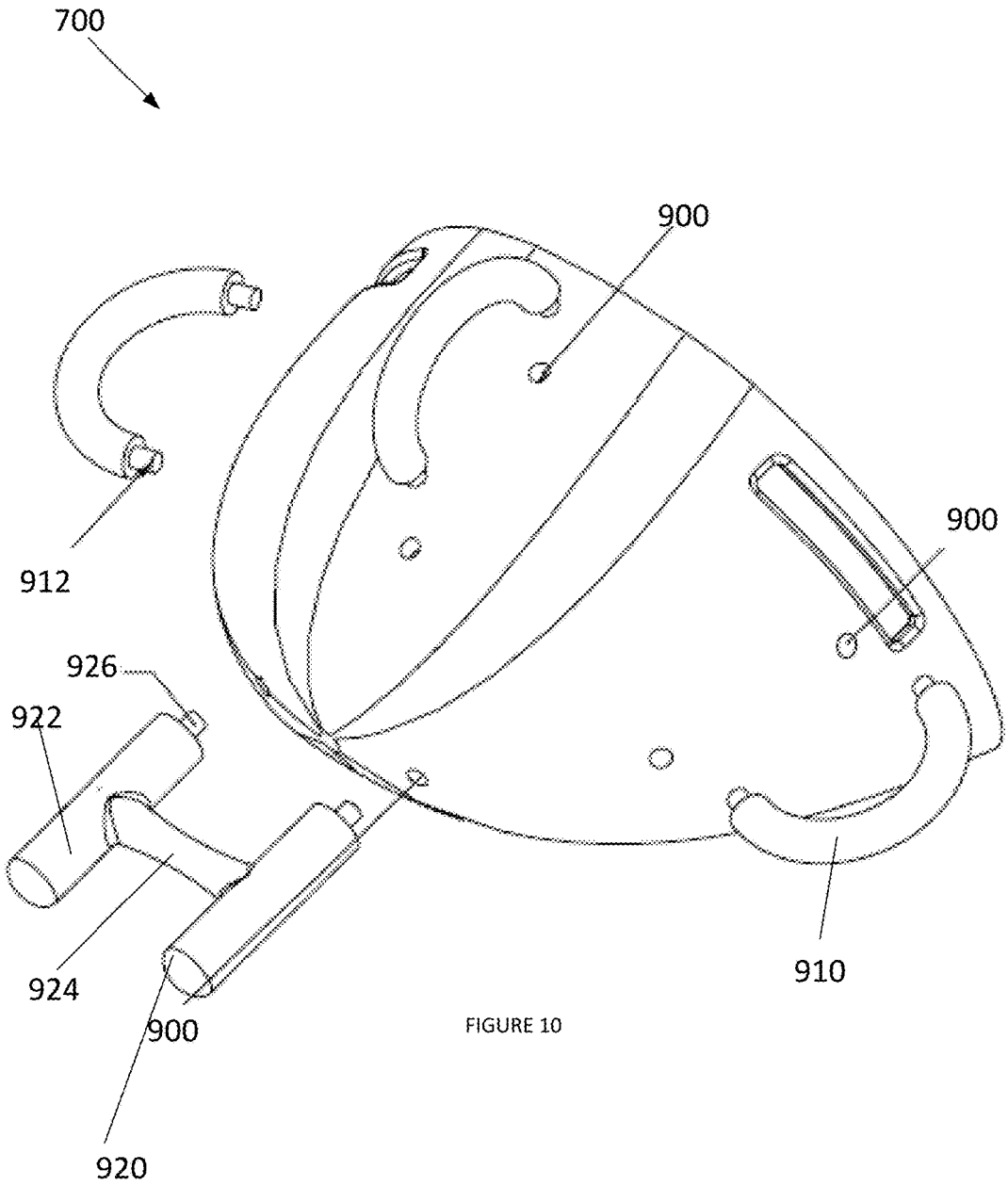
FIG. 10 depicts an exploded view of a shoe cover, according to an embodiment.

FIG. 10 depicts an exploded view of an embodiment of shoe cover 700 with a plurality of female holes 900, and a plurality of attachment members 910 and 920.

First type of attachment members 910 may be configured to be positioned along the upper, rounded surface of shoe cover 700. First type of attachment members 910 may include male projections 912 configured to be inserted into corresponding female holes 900. Responsive to coupling male projections 912 with female holes 900, first type of attachment members 910 may be coupled with shoe cover 700. In embodiments, two first types of attachment members 910 may be positioned on opposite sides of shoe cover 700, and single first type of attachment member 910 may be positioned on the upper surface of shoe cover 700. The first type of attachment members 910 positioned on the sides of shoe cover 700 may be positioned substantially perpendicular to the first type of attachment member 910 positioned on the upper surface of shoe cover 700.

Second type of attachment member 920 may be positioned on the closed end of shoe cover 700. Second type of attachment member 920 may include male projections 926 configured to be inserted into corresponding female holes 900. Responsive to coupling male projections 926 with female holes 900, second type of attachment member 920 may be coupled with shoe cover 700. Second type of attachment member 920 may be substantially "H" shaped, and extend away from shoe cover 700 in a downward angle that is substantially similar to the angle of the first type of attachment members 910 positioned on the sides of shoe cover 700.

In embodiments, second type of attachment member 920 may include two rails 922 and a bar 924. The two rails 922 may be configured to extend away from shoe cover in parallel to one another, and bar 924 may be configured to extend across the two rails 922 in a direction perpendicular to the two rails 922. By positioning the two rails 922 in parallel to each other and bar 924 perpendiculars to rails 922, a cable pulley may be configured to remain in the space between the end of shoe cover 700 and bar 924. The extensions of the rails 922 may be configured to guide the cable pulley while in use, such that the cable pulley does not veer or turn towards either side of the shoe while in use.

Figure 11:
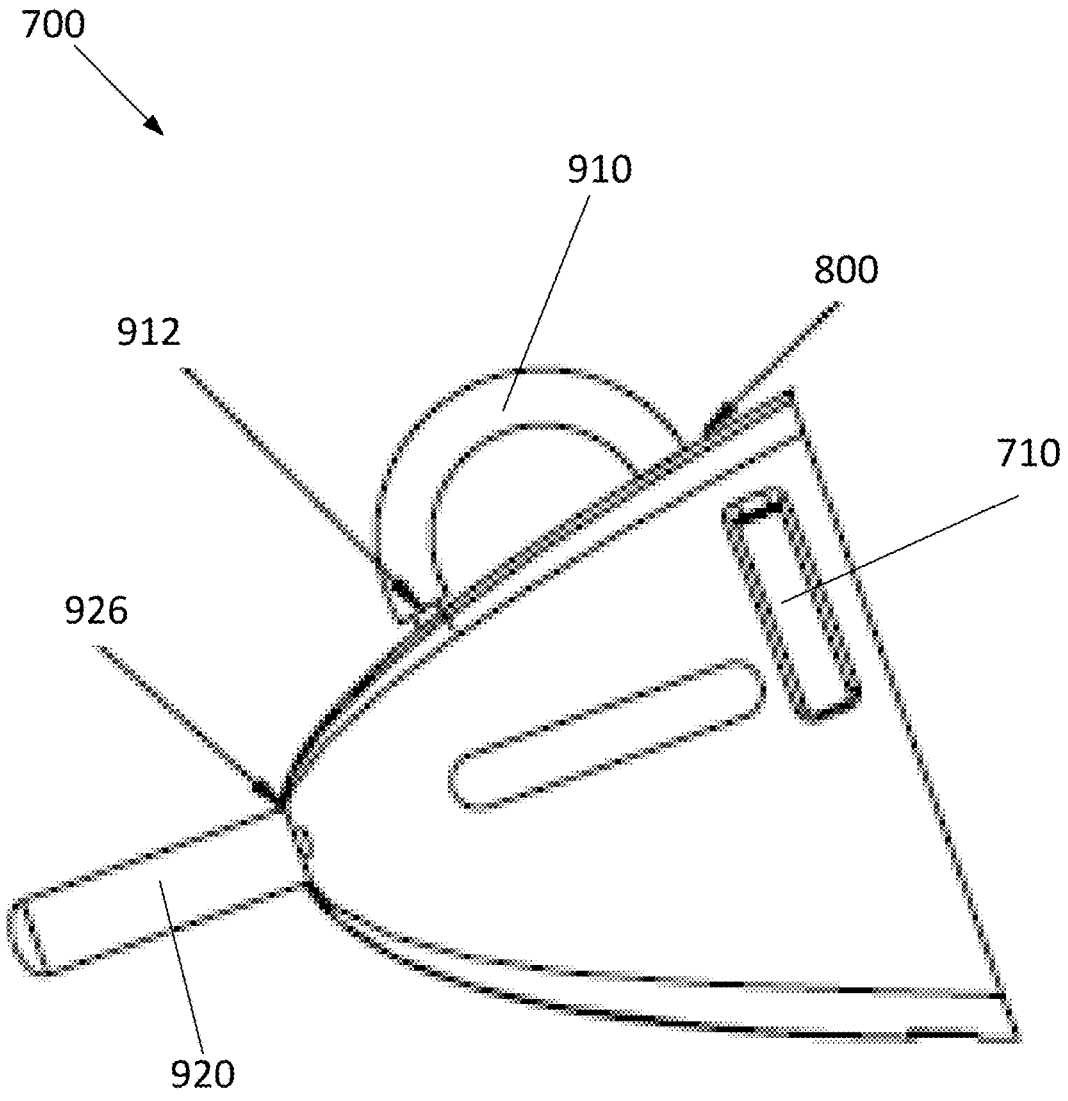
FIG. 11 depicts a side view of a shoe cover, according to an embodiment.

FIG. 11 depicts a side view of shoe cover 700 with first type of attachment members 910 and second type of attachment member 920. As depicted in FIG. 11, first type of attachment members 910 may be positioned in front of slot 710, which may be close to a lower edge of slot 710. The positioning of first type of attachment members 910 in relation to slot 710 may more efficiently distribute force applied to shoe cover 700 to a foot of a user. As also depicted in FIG. 10, the first type of attachment members 910 and second type of attachment members 920 may be positioned at a downward angle.

Figure 12:
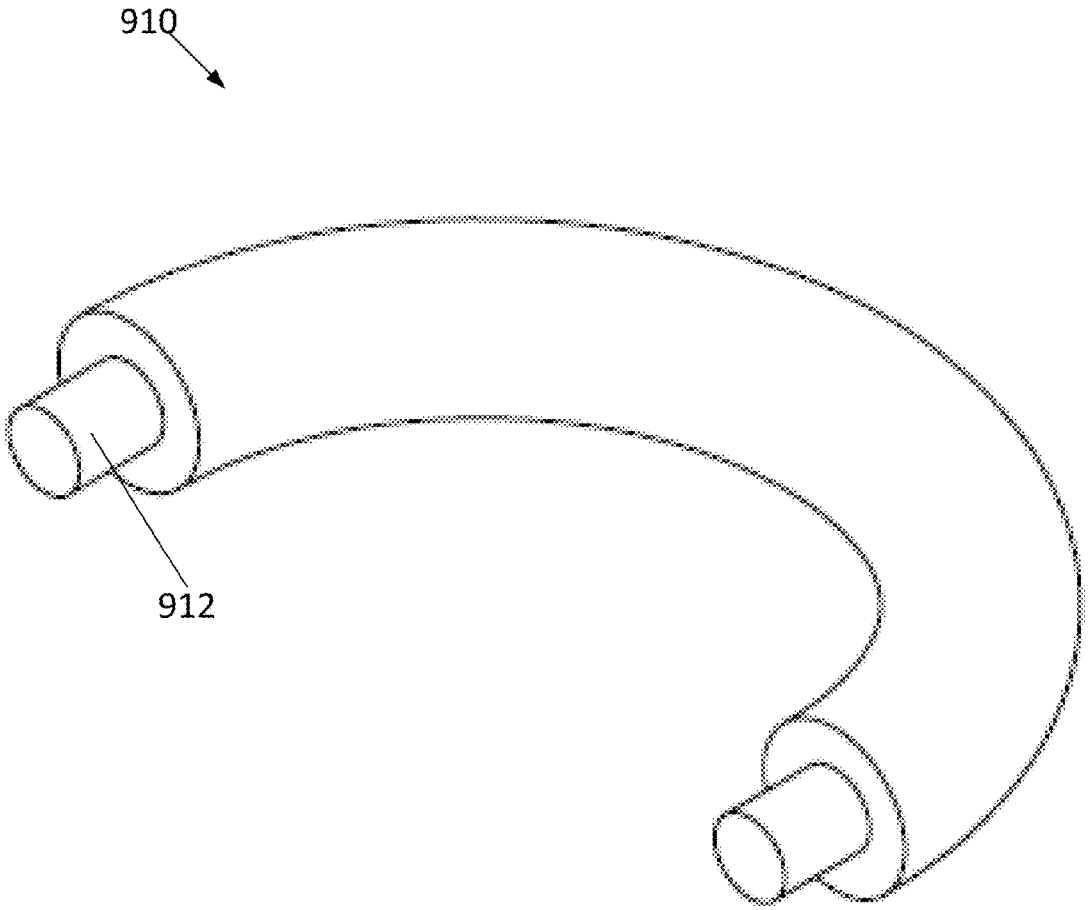
FIG. 12 depicts one embodiment of first attachment member, according to an embodiment.

FIG. 12 depicts one embodiment of first attachment member 910. As depicted in FIG. 12, first attachment member 910 may include a semi-circle arch extending from a first end of first attachment member 910 to a second end of first attachment member 910. Due to the circular arch, resistance may be applied to first attachment member 910 in a plurality of different directions, and cable straps, pulleys, or free weights may be coupled to first attachment member 910 at various angles. Furthermore, male projections 912 may be positioned at both ends of first attachment member 900.

Figure 13:
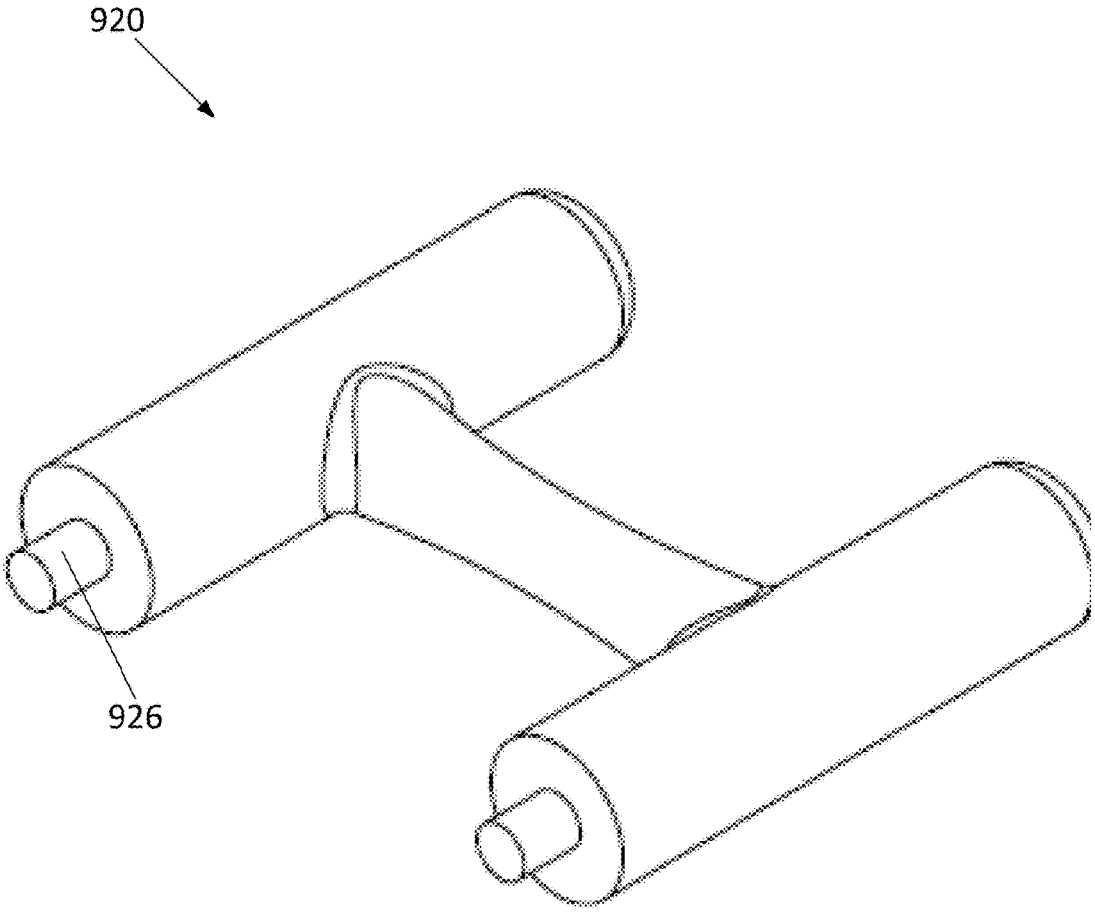
FIG. 13 depicts one embodiment of second attachment member, according to an embodiment.

FIG. 13 depicts one embodiment of second attachment member 920. As depicted in FIG. 13, second attachment member 920 may include rails 922, bar 924, and male attachment members 926. Rails 922 may extend away from a shoe cover in parallel, and bar 924 may extend across rails 922 in a direction that is parallel to rails 922. Based on the positioning of rails 922 and bar 924, second attachment member may maintain cable straps, pulleys, or free weights in a fixed position in-front of the shoe, without the cable straps, pulleys, or free weights veering. More specifically, a cable strap, pulley, or free weight may be coupled to bar 924, and rails 922 may guide the strap, pulley, or free weight.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems, methods, and computer program products according to various embodiments of the present invention. It will also be noted that each block of the block diagrams and/or flowchart illustrations, and combinations of blocks in the block diagrams and/or flowchart illustrations, may be implemented in different orderings, combinations, etc., with additional blocks and/or blocks removed.

What is claimed is:

1. An exercise device comprising:

a shoe cover configured to cover an end of a shoe, the shoe cover having a top surface, and a bottom surface, the top surface being downwardly angled and the bottom surface being upwardly angled, wherein the downward angle being greater than the upward angle, and the bottom surface being longer in length than the top surface;

a plurality of slots configured to receive straps positioned proximate to an open end of the shoe cover, wherein two of the plurality of slots are positioned on the top surface of the shoe cover, and one of the plurality of slots are positioned on the bottom surface;

a plurality of first type of attachment members being coupled to the shoe cover;

a second type of attachment member being coupled to the shoe cover, the second type of attachment member being a different shape than the first type of attachment members.

2. The exercise device of claim 1, wherein the first type of attachment member is semi-circle in shape.

3. The exercise device of claim 1, wherein the one of the plurality of slots positioned on the bottom surface is positioned further away from a closed end of the shoe cover than the two of the plurality of slots positioned on the bottom surface.

4. An exercise device comprising:

a shoe cover configured to cover an end of a shoe, the shoe cover having a top surface, and a bottom surface, the top surface being downwardly angled and the bottom surface being upwardly angled, wherein the downward angle being greater than the upward angle, and the bottom surface being longer in length than the top surface;

a plurality of slots configured to receive straps positioned proximate to an open end of the shoe cover a plurality of first type of attachment members being coupled to the shoe cover;

a second type of attachment member being coupled to the shoe cover, the second type of attachment member being a different shape than the first type of attachment members;

a plurality of slots configured to receive straps positioned proximate to an open end of the shoe cover wherein the second type of attachment member is "H" shaped.

5. An exercise device comprising:

a shoe cover configured to cover an end of a shoe, the shoe cover having a top surface, and a bottom surface, the top surface being downwardly angled and the bottom surface being upwardly angled, wherein the downward angle being greater than the upward angle, and the bottom surface being longer in length than the top surface;

a plurality of slots configured to receive straps positioned proximate to an open end of the shoe cover;

a plurality of first type of attachment members being coupled to the shoe cover;

a strap system is configured to interface with the plurality of slots to couple the shoe cover to the shoe, wherein the strap system includes two side straps configured to be positioned on sides of the shoe, and a bottom strap configured to be positioned on a sole of the shoe.

6. The exercise device of claim 5, wherein the strap system includes a circumference strap that is configured to be positioned around a circumference of the shoe, and the circumference strap is configured to interface with the side straps and the bottom strap.

7. The exercise device of claim 5, wherein at least two of the first type of attachment members are positioned perpendicular to each other.

* * * * *